United States Patent [19]

Wachter

[11] Patent Number: 4,707,875

[45] Date of Patent: Nov. 24, 1987

[54] HOLDING MEMBER FOR WORKING ELEMENTS OF ROLLER BRUSHES

[75] Inventor: Johann Wachter, Mannsworth, Austria

[73] Assignee: Famag Fahrzeug- und Maschinenhandelsgesellschaft m.b.H. Nfg. KG., Vienna, Austria

[21] Appl. No.: 763,264

[22] Filed: Aug. 6, 1985

[30] Foreign Application Priority Data

| | | | |
|---|---|---|---|
| Aug. 6, 1984 | [AT] | Austria | 2545/84 |
| Nov. 5, 1984 | [AT] | Austria | 3498/84 |
| Nov. 5, 1984 | [AT] | Austria | 3499/84 |
| Jul. 24, 1985 | [EP] | European Pat. Off. | 85890164 |

[51] Int. Cl.[4] ..... A46B 13/02

[52] U.S. Cl. ..... 15/179; 15/183; 15/82; 15/159 A; 299/39; 29/81 J

[58] Field of Search ..... 15/182, 183, 179, 82, 15/83, 55, 198, 200, 159 A; 299/39; 29/81 E, 81 G, 81 J

[56] References Cited

U.S. PATENT DOCUMENTS

| | | | |
|---|---|---|---|
| 745,273 | 11/1903 | Brantley . | |
| 808,006 | 12/1905 | Butler . | |
| 2,773,275 | 12/1956 | Peterson . | |
| 2,897,527 | 8/1959 | Jones . | |
| 3,023,440 | 3/1962 | Peabody et al. . | |
| 3,085,274 | 4/1963 | Vincent et al. . | |
| 3,134,123 | 5/1964 | Nelson . | |
| 3,142,854 | 8/1964 | Nielsen . | |
| 3,200,430 | 8/1965 | Haracz . | |
| 3,228,053 | 1/1966 | Horton . | |
| 3,241,172 | 3/1966 | Tilgner . | |
| 3,278,966 | 10/1966 | Godfrey . | |
| 3,545,026 | 12/1970 | Beer | 15/183 |
| 3,599,264 | 8/1971 | Smith, Jr. et al. . | |
| 3,643,283 | 2/1972 | Jahnert et al. | 15/82 |
| 3,751,745 | 8/1973 | Smith, Jr. et al. . | |
| 3,862,462 | 1/1975 | Reiter . | |
| 3,995,346 | 12/1976 | Grogan et al. . | |
| 4,077,081 | 3/1978 | Drumm . | |
| 4,332,422 | 6/1982 | Hilshorst . | |

FOREIGN PATENT DOCUMENTS

| | | | |
|---|---|---|---|
| 268366 | 2/1969 | Austria . | |
| 305350 | 2/1973 | Austria . | |
| 307481 | 5/1973 | Austria . | |
| 552629 | 12/1959 | Belgium . | |
| 286512 | 3/1914 | Fed. Rep. of Germany . | |
| 352183 | 6/1920 | Fed. Rep. of Germany . | |
| 289181 | 8/1928 | Fed. Rep. of Germany . | |
| 286513 | 3/1929 | Fed. Rep. of Germany . | |
| 815967 | 8/1951 | Fed. Rep. of Germany . | |
| 862308 | 11/1952 | Fed. Rep. of Germany . | |
| 1210409 | 2/1966 | Fed. Rep. of Germany . | |
| 3246118 | 6/1984 | Fed. Rep. of Germany . | |
| 484816 | 11/1917 | France . | |
| 978183 | 11/1950 | France | 15/159 A |
| 316070 | 9/1956 | Switzerland . | |
| 668304 | 3/1952 | United Kingdom | 15/159 A |
| 726940 | 3/1955 | United Kingdom . | |
| 962604 | 7/1964 | United Kingdom | 15/179 |

*Primary Examiner*—Peter Feldman

*Attorney, Agent, or Firm*—Young & Thompson

[57] ABSTRACT

Several holding members (1) are arranged over the outer surface of the brush core in radial and axial distribution for working elements (2) of roller brushes to treat traffic areas, especially in order to remove, for the surface of the latter, coatings such as dirt, snow, ice, paint, abraded rubber, or the like, and the working elements (2) are retained so that they are pivotably movable with respect to the brush core about axes in parallel to the axis of rotation of the brush, the working elements (2) being attached to the holding members (1) in the zone of a radially outwardly located head (3) of the holding member (1).

23 Claims, 23 Drawing Figures

HOLDING MEMBER FOR WORKING ELEMENTS OF ROLLER BRUSHES

Figure 1:
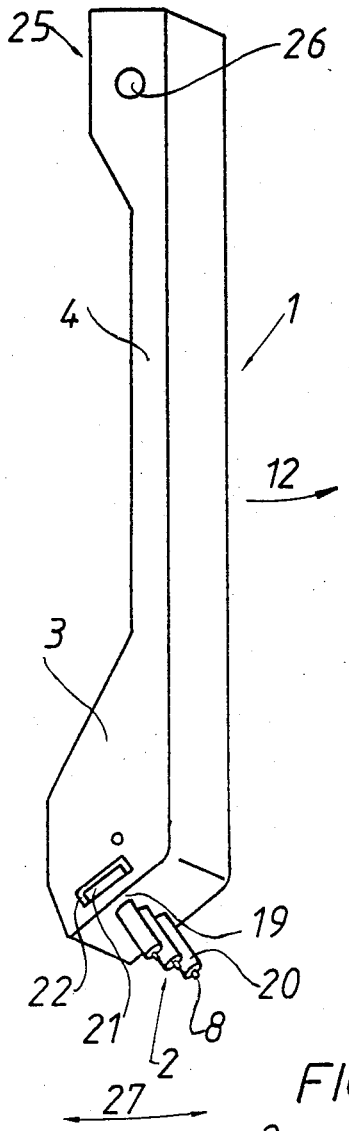

The invention relates to a holding member for working elements of roller brushes to treat traffic areas, in particular to remove from the surface of the latter coatings, such as dirt, snow, ice, paint, abraded rubber, or the like, several holding members being arranged in radial and axial distribution over the outer surface of the brush core and retaining the working elements so that the latter are pivotably movable with respect to the brush core about axes in parallel to the axis of rotation of the brush.

Circular brushes (roller brushes) are known in a great variety of different designs.

Thus, roller brush structures are known from German Patent No. 815,967, British Patent No. 726,940, and U.S. Pat. Nos. 3,134,123, 3,200,430, and 3,228,053 wherein strip-shaped mountings for bristle clusters can be inserted in axially parallel grooves of the brush body. In all these conventional circular brushes, the bristle clusters are retained so that they are not pivotable with respect to the brush body, and they can deviate from their position, wherein they project radially from the brush body, only with elastic deformation of the individual bristles proper.

In another group of circular brushes, the bristle clusters are articulated to an essentially cylindrical carrier member (brush core), there being no resultant preferred pivoting axis of the bristle clusters. Thus, German Patent No. 286,512 discloses a circular brush wherein the bristle groups are attached via coil springs to the brush body to be pivotable in all directions. German Patent No. 352,183 describes a circular brush serving as a matte-polishing beater brush wherein bristle clusters are attached to a supporting member so that they are pivotable via several rings into desired directions. Another possibility of a connection pivotable in all directions for bristle clusters of a revolving circular brush with the supporting member of the latter is shown in German Patent No. 289,181 wherein pins with flattened heads, to which the bristle clusters are attached, engage through holes in the tubular supporting member and are held at that location by the heads. Finally, German Patent No. 286,513 discloses the arrangement of rubber strips instead of the bristles for a scrubbing roller for street cleaning machines, these rubber strips being attached to the core of the roller brush via coil springs and nuts.

Austrian patent application No. 100/84, published on Feb. 15, 1985, describes a roller brush for track-laying machines wherein hose-like clearing arms are attached to the brush core by means of a clamping screw connection. The hose-like clearing arms are to consist of a flexurally elastic material and do not exhibit any design features at their radially outer ends to prevent increased wear.

It has also been suggested (cf. Austrian Patent No. 305,350 and U.S. Pat. No. 3,545,026) to design, in circular brushes, bristles which are pivotable about axes in parallel to the axis of rotation of the brush, but the pivotability of the bristles merely serves for adjusting the bristles in a specific angular position with respect to the radial plane. Similar suggestions are contained in U.S. Pat. No. 3,545,026 wherein the pivoting of the bristles is to take place automatically under the contact pressure of the roller brush against the object to be cleaned.

It is finally also conventional from British Patent No. 962,604 to attach bristle clusters on the core of a roller brush by way of clamping means and elastic intermediate members provided at that location, so that the bristle clumps can move elastically to and fro with elastic deformation of the connecting elements, about axes in parallel to the axis of rotation of the roller brush. The brush structure disclosed in British Patent No. 962,604 is, however, very expensive with respect to the mounting of the bristle clusters with clamping means and multiple rivet and/or screw connections; moreover, the exchanging of worn bristle clumps is troublesome.

All of these conventional roller brushes exhibit the disadvantage that comparatively long bristles (working elements) are utilized which are fashioned to be correspondingly elastic and consequently have little wear resistance.

The known circular brushes have the drawback that a compromise must be sought when selecting the material for the bristles, between abrasion resistance and the elastic properties of the bristles required for the purpose of usage of the circular brush.

In contrast, the invention is based on the object of providing a holding member for roller brushes of the type discussed hereinabove wherein, on the one hand, the advantage is provided of an easy exchangeability of the fittings, be it after they have worn down or in order to adapt the fittings to the respective purpose of utilization of the roller brush and, additionally, the bristle elements can be pivoted about axes in parallel to the axis of rotation of the roller brush.

This has been achieved according to the invention by attaching the working elements to the holding members in the zone of a radially outwardly located head of the holding member.

An essential advantage of the invention resides in that holding members, separated from the actual working elements, are provided herein, serving for connecting the working elements with the brush body, so that the respectively most suitable material can be used for the holding member, on the one hand, and the working element, on the other hand. Since, moreover, the holding members are equipped with head parts on their radially outwardly disposed ends, studded with the working elements which act on the surface of the (traffic) area to be worked, the section of the holding member connecting the head part of the latter with the brush core, i.e. the shank of the holding member, can be designed to be lightweight and optionally elastic and/or articulated, whereas merely the working elements may be selected to be especially wear-resistant and/or so that they can perform the task for which they are intended.

The invention provides the advantage that the working elements need no longer meet special requirements with respect to their elastic properties, since the tubular, rod-shaped, or strip-like holding members can be mounted at the brush core to be pivotable in radial planes and/or to be elastic in their design.

The invention furthermore permits modification of the holding members of roller brushes and also equipment of one and the same roller brush with differing working elements, if this is desirable for a special purpose of usage. The working elements provided can be the customary bristle clumps (which, however, are only quite short in this case), strips of an elastic material, pins, especially of hard material, and polygonal platelets acting on the surface to be worked with a corner or with a lateral edge.

Figure 8:
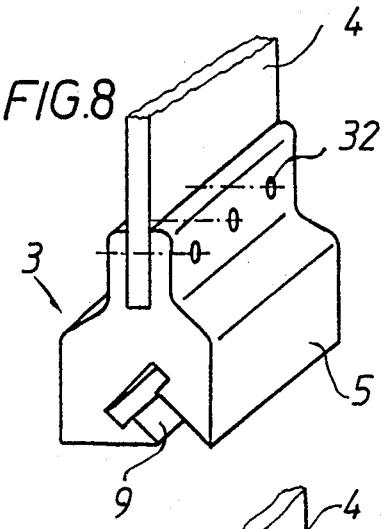
Figure 9:
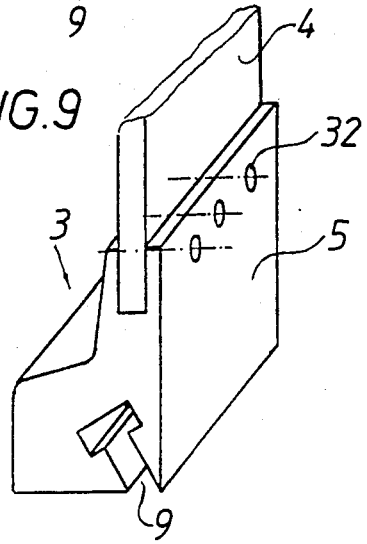
Figure 11:
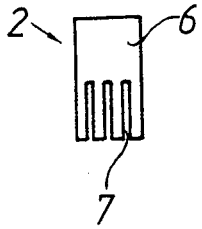
Figure 10:
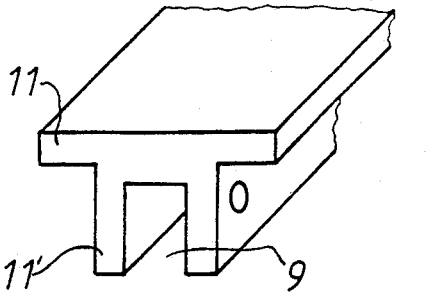
Figure 2:
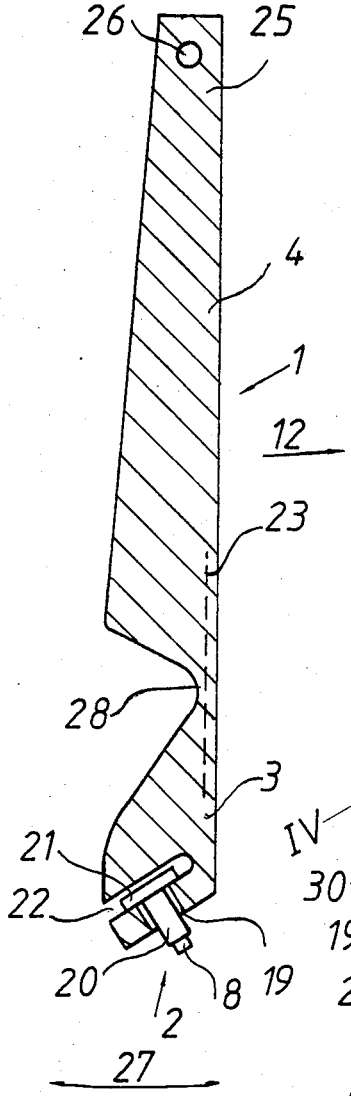
Figure 3:
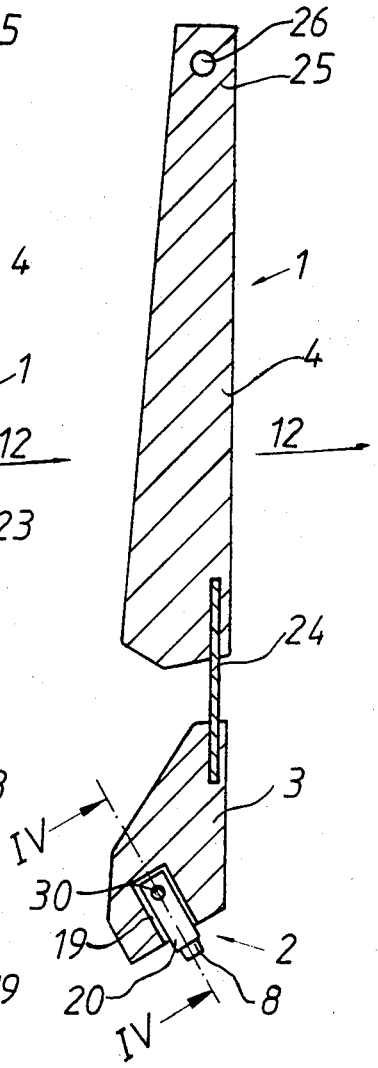
Figure 5:
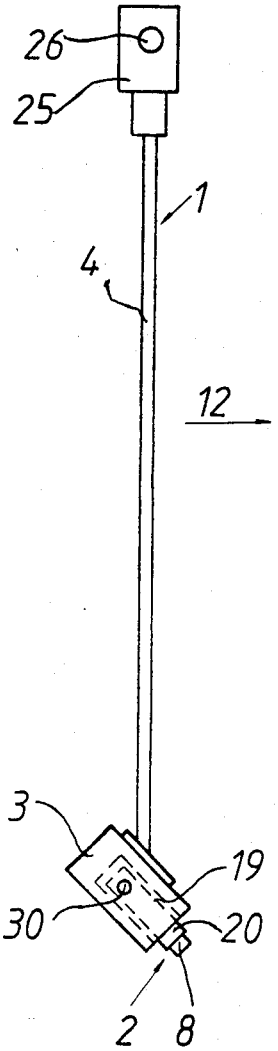
Figure 4:
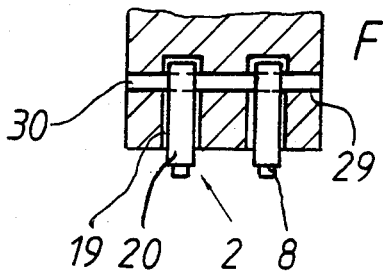
Figure 6:
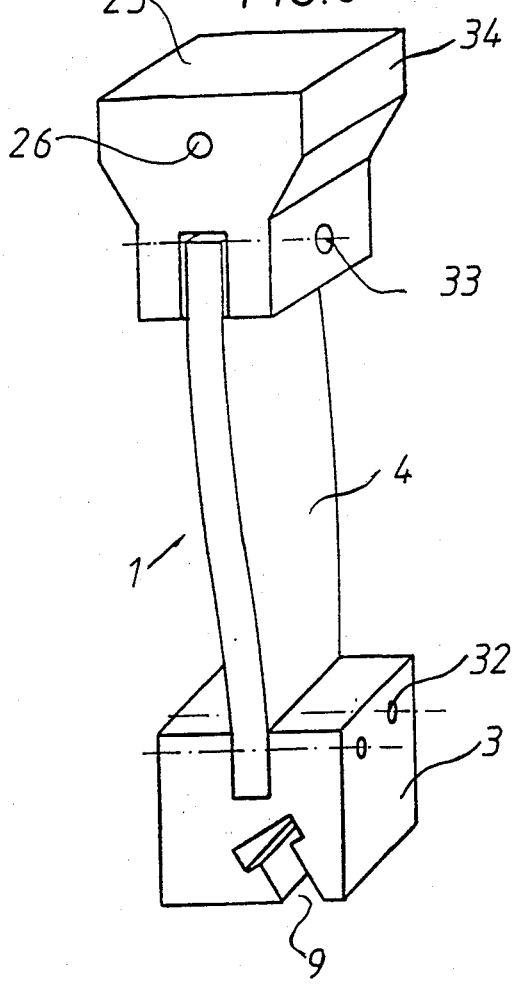
Figure 7:
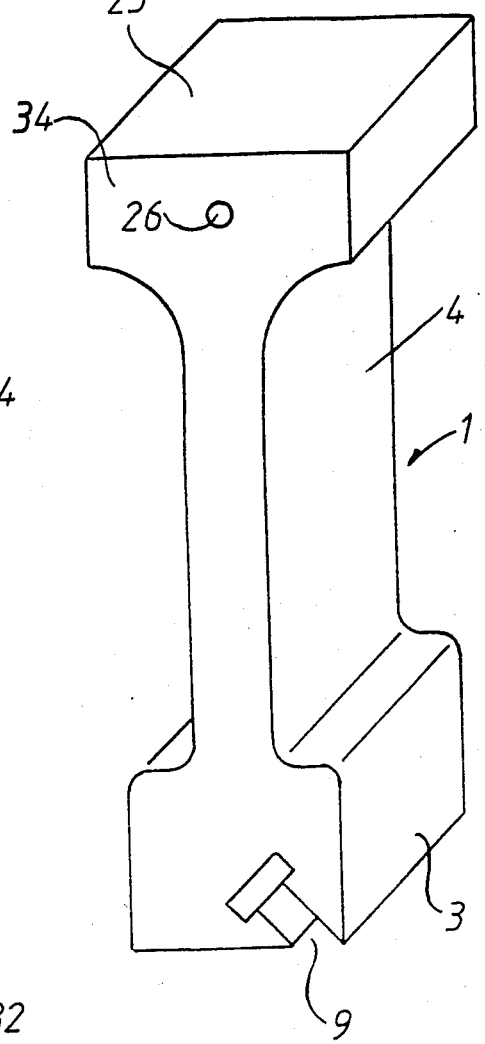
Figure 12:
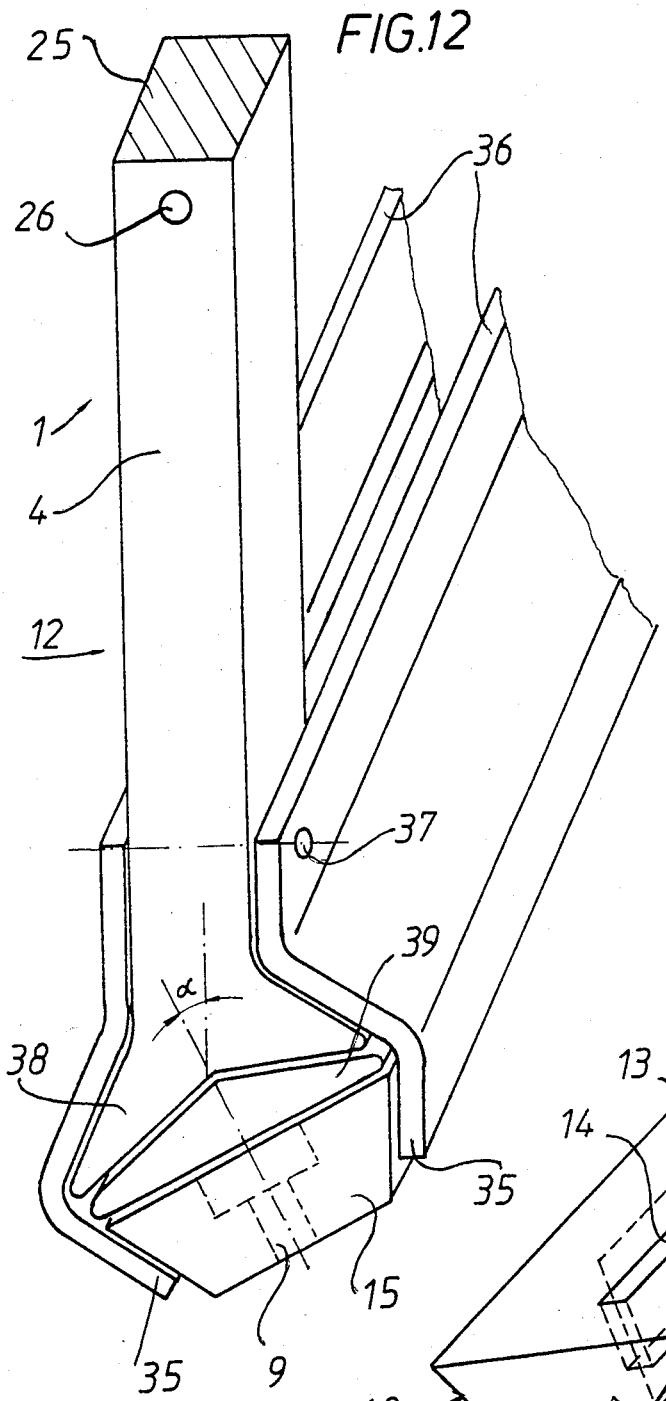
Figure 13:
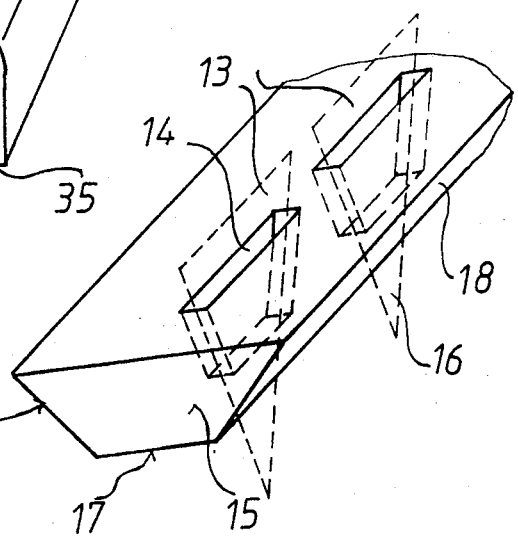
Figure 14:
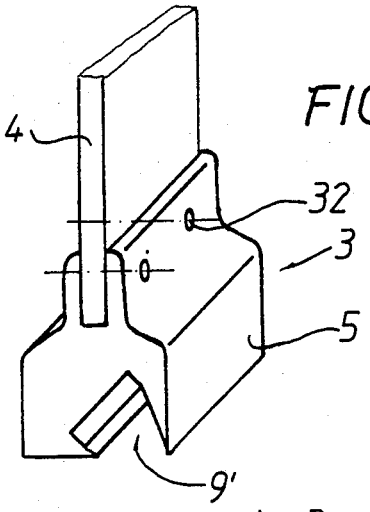
Figure 15:
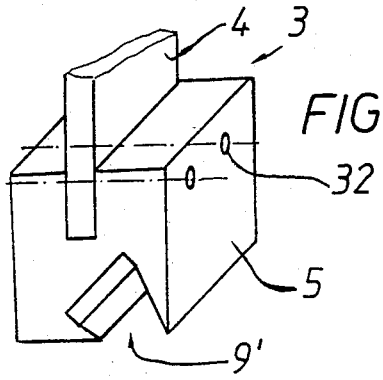
Figure 16:
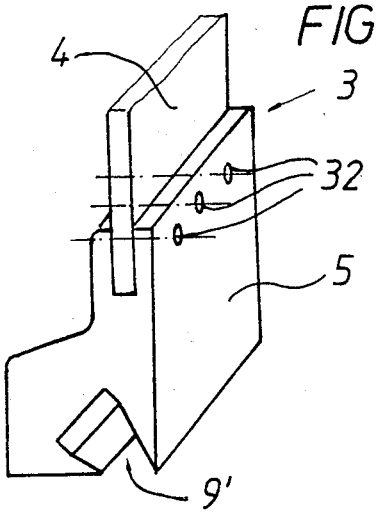

Details of the invention will be described with reference to the drawings, schematically illustrating embodiments of the holding member of this invention. In the drawings:

FIG. 1 is an oblique view of a first embodiment of a holding member according to the invention, FIG. 2 is a longitudinal sectional view of a second embodiment of the holding member according to the invention, FIG. 3 shows, in a longitudinal sectional view, another embodiment of the holding member according to the invention, FIG. 4 shows a section along line IV—IV in FIG. 3, FIG. 5 shows a fourth embodiment, FIG. 6 shows, in an oblique view, a fifth embodiment of a holding member according to the invention, FIG. 7 shows, in an oblique view, a sixth embodiment, FIG. 8 shows, in an oblique view, an exemplary embodiment of a head of the holding member according to the invention, FIG. 9 shows, in an oblique view, another embodiment of a head of the holding member according to the invention, FIG. 10 shows, in a partial, oblique illustration, a detail, namely a mounting rail for working elements, FIG. 11 shows a working element, as a detail, FIG. 12 shows, in an oblique view, a seventh embodiment of a holding member according to this invention, FIG. 13 shows a mounting strip with polygonal working elements in an oblique view, FIGS. 14–16 show embodiments of heads for the holding member of this invention, respectively in an oblique view, and FIGS. 17–23 show head configurations of the holding member of this invention with working elements being inserted therein, respectively in an oblique view.

The holding member 1 according to the embodiment illustrated in FIG. 1 comprises a head 3 and a shank 4, which latter has at its end a mounting 25 with a bore 26 provided for connecting the holding member 1 with the core of a circular brush (roller brush), not illustrated in detail, by means of mounting pins. The direction of rotation of the roller brush is indicated by arrow 12.

The core of the circular brush can have a conventional design, thus as known, for example, from Austrian Patent No. 366,126. The holding member 1 is connected to the core of the circular brush so that the holding member 1 can be pivoted about an axis in parallel to the axis of the circular brush and defined by the bore 26.

The shank 4 tapers with respect to the head 3 and the mounting 25, and accordingly the holding member 1 can swing to and fro with respect to the mounting 25 in the direction of double arrow 27.

Bores 19 are provided in the head 3 for receiving working elements 2 which, in accordance with the embodiment, consist of pins 8 made of a hard material. The pins 8 are surrounded by the jacket 20 which has a clearance with respect to the bores 19 and is equipped with a flange 21 retained with play in a slot 22 of the head 3.

In the embodiment of a holding member 1 according to this invention shown in a sectional view in FIG. 2, the head 3 is of the same structure as depicted in FIG. 1. Also the working elements 2 in the form of pins 8, with a jacket 20 and a flange 21, as well as their mounting with play in bores 19 and a slot 22 of the head 3 correspond to the embodiment of FIG. 1.

The head 3 and the mounting 25 with the bore 26, as well as the shank 4, are made of a rubber-elastic material. A joint 28 is arranged between the head 3 and the shank 4, permitting pivoting of the head 3 with respect to the shank 4 in the direction of double arrow 27. For reinforcing the holding member 1 in the zone of the joint 28, an insert 23 is provided which can be designed as a spring strip.

FIG. 2 also shows that the mounting 25 and the head 3 have a wedge-shaped configuration so that their cross sections respectively widen toward the end of the holding member 1 studded with the pin or pins 8. This has the effect that the center of gravity of the holding member of this invention lies in the zone of the joint 28. Although the joint 28 could also be located in the center of the holding member 1, the joint 28, in the preferred embodiment illustrated in FIG. 2, is arranged in the surface of the holding member 1 which is at the front in the direction of rotation (arrow 12).

In the embodiment shown in FIGS. 3 and 4, the mounting 25 and the head 3 are fashioned as components that are independent of each other, joined via a strip 24 of a spring-elastic material, such as, for example, spring steel. The strip 24 is attached in the head 3 and in the mounting 25, respectively, by way of fastening means not shown in detail, such as screws, bolts, or the like, or, alternatively, by means of welding, gluing, etc.

For the accommodation of the working elements 2 in the form of pins 8, the head 3 is again provided with a bore 19 and/or with two bores 19, as in the illustrated example. Furthermore, the head 3 exhibits a cross bore 29 penetrating the bores 19. The pins 8 again are surrounded by a jacket 20, which latter has at its end a bore, not indicated in detail, for receiving a mounting pin 30. Also in the embodiment shown in FIGS. 3 and 4, the jacket 20 has a clearance with respect to the bore 19, and the mounting pin 30 can also have a play with respect to the cross bore in the jacket 20 of the pins 8.

In the holding member 1 shown in FIG. 5, a rod 31 of an elastic material (metal or synthetic resin) is provided in place of the shank 4. The holding member 1 can be rigidly attached to the core of a circular brush (not shown) by way of a base-like mounting 25. It is understood that also in the embodiment shown in FIG. 5 the holding member 1 can be pivotably attached to the core of the circular brush, for example by providing an eye in place of the mounting 25. The holding member 1 carries a head 3 wherein one or several pins 8 are inserted, similarly as in the embodiment of FIGS. 3 and 4. The head 3 can also be of the structure shown in FIG. 2.

It can also be seen from FIGS. 1–5 that the pins 8, lying in a plane perpendicular to the axis of the circular brush, to which the holding members 1 are to be fastened, extend inclined to the longitudinal extension of the holding member 1, the free ends of the pins 8 pointing toward the front, i.e. in the direction of rotation (arrow 12). This inclination of the pins, for example also bristles, and also the arrangement of the joint 28 located in the zone of the leading surface of the holding member 1, results in a holding member specific with respect to the direction of rotation. If a holding member is to be provided which is usable for both possible directions of rotation of a circular brush, then the working elements 2 will extend in the longitudinal direction of the holding member 1, and also the joint 28 will be diposed in the longitudinal central plane of the holding member 1.

The holding members 1 according to FIGS. 1–5 can also be attached rigidly to the core of the circular brush.

FIG. 6 illustrates a holding member 1 wherein the head 3, the shank 4, and the mounting 25 consist of separate individual parts joined together by means of bolts, screws, or the like denoted by 32 and 33, respectively. The head 3 exhibits a groove 9 T-shaped in cross section, serving for the attachment of working elements, for example of the type of pins 8, surrounded by a jacket 20 carrying a flange 21 as shown in FIGS. 1 and 2. The shank 4 can consist of an elastically flexible material and is inserted in grooves in the head 3 and in the mounting 25. The mounting 25 comprises a widened base 34 and a bore 26 intended for connection with the core of a circular brush (roller brush). This core is equipped with corresponding grooves.

The holding member 1 according to FIG. 7 exhibits a configuration similar to that of the holding member 1 shown in FIG. 6, but the head 3, the shank 4, and the mounting 25 are fashioned of one piece. The head 3 again has a groove 9, T-shaped in cross section, for the accommodation of working elements. The mounting 25 is equipped with a bore 26 and a flange-like base 34 for anchoring at the core of a circular brush.

In FIG. 8, a head 3 serving as a connecting member 5 is illustrated, fashioned symmetrically to the shank 4 and exhibiting, for the accommodation of the latter, a groove, and bolts, screws, or the like 32, for attachment. Again, a groove 9, T-shaped in cross section, is provided for working elements. In this connection, the working elements can also be supported by holding strips formed in correspondence with the grooves 9.

An asymmetrical configuration of a connecting member 5 serving as the head 3 is shown in FIG. 9. The multipartite design of the holding members 1 according to FIGS. 6, 8, and 9 has the advantage that an elastic material can be employed for the shanks 4, whereas the heads 3 and/or connecting members 5, on the one hand, or the mountings 25, on the other hand, can be manufactured from a more rigid material. The connection of the shanks 4 to the heads 3 and/or the connecting members 5 and to the mountings 25 can also be effected by cementing.

FIG. 10 depicts the end of a mounting rail 10 for the working elements, this rail having a T-shaped cross section, a flange 11 serving for connection with preferably several shanks (not shown), and the web sections 11' defining a groove 9 for the accommodation of working elements. These working elements 2 can consist, according to FIG. 11, of strips 6 fashioned of a lamellar shape with the aid of slits 7.

The holding member 1 illustrated in FIG. 12 exhibits, for an optionally pivotable connection with the core of a circular brush, a merely indicated mounting 25 with a bore 26 at the shank 4. For the mounting of working tools, a groove 9, having a T-shape in cross section, is provided in a holding strip 15 having a trapezoidal cross section. This holding strip 15 is seized by obliquely converging flanks 35 of profiled rails 36 which themselves are connected with optionally several shanks 4 by means of screws, rivets, or the like 37. In adaptation to the profiled rails 36, the shank 4 (the shanks 4) exhibit(s) widened head portions 38. A pressure member 39 can be arranged between the mounting strip 15 and the head portion 38, preventing the working elements inserted in the mounting strip 15 from being forced inwardly. It can be seen from FIG. 12 that the working elements form an acute angle $\alpha$ of 0°–45° with the longitudinal axis of the holding member 1 and/or its shank 4, i.e. they point forwardly in the direction of movement according to arrow 12.

Another embodiment is illustrated in FIG. 13 wherein the holding strip 15 has wedge-shaped recesses 14 in which working elements in the form of triangular, quadrangular or polygonal platelets 13 can be inserted so that their tips 16 project past the outer surface 17 of the holding strip 15. Such working elements can be utilized for machining grooves into traffic areas, for example to improve their drainage effect. Strip 15 has converging side surface 18 that coact with the head structure as in FIG. 12. In an embodiment modified with respect to FIG. 13, the platelets 13 can project with a lateral edge from the recesses 14 past the outer surface 17 of the mounting strip 15, Such working blades have, for example, a trapezoidal contour.

FIGS. 14, 15, and 16 illustrate connecting members 5 for the formation of heads 3 connected with shanks 4, for example by means of screws, rivets, or the like, or by means of gluing, wherein the connecting members are provided with grooves 9', trapezoidal in cross section, for the reception of working elements, optionally with the aid of mounting strips. FIGS. 14 and 15 show connecting members fashioned symmetrically to the shanks 4; FIG. 16 shows an asymmetrical connecting member.

Figure 17:
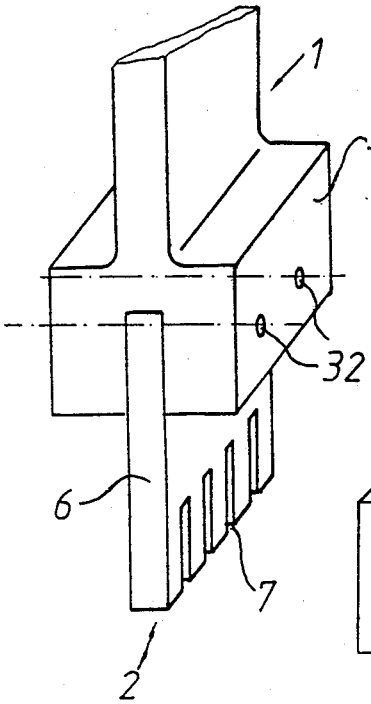

FIG. 17 depicts the mounting of a working element 2, fashioned as a strip 6 with slits 7 according to FIG. 11, at the head 3 of a one-piece holding member 1, the head 3 exhibiting a groove for the accommodation of, and screws, rivets, or the like for the attachment of, the strip 6. A strip having a wider configuration could also accommodate the slits extending in its longitudinal direction.

Figure 18:
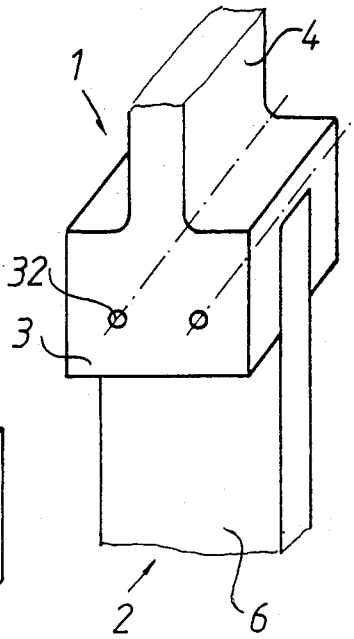

FIG. 18 illustrates the mounting of a strip 6 as the working element 2, the strip 6 being oriented perpendicularly with respect to the shank 4 of the holding member 1. In this arrangement, the head 3 has a groove to receive the strip 6, and mounting takes place by means of screws, rivets, or the like 32, or by cementing.

Figure 19:
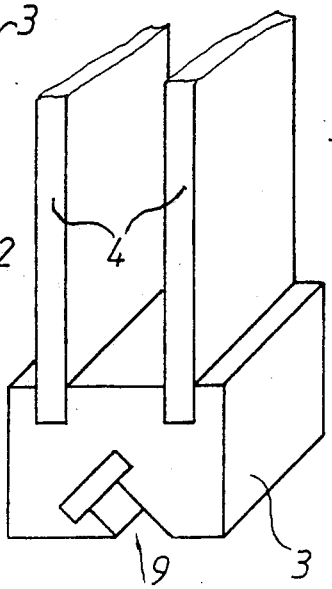

According to FIG. 19, a head 3 is connected to a pair of shanks 4 and exhibits a groove 9, having a T-shape in cross section, for the attachment of working elements.

Figure 20:
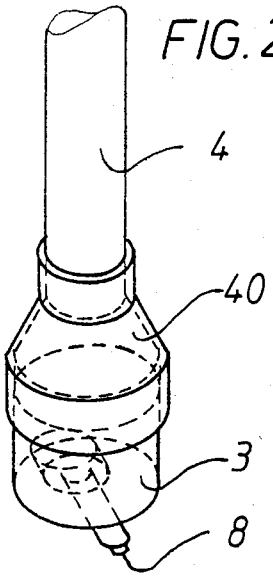

FIG. 20 shows a possibility for attaching a cylindrical head 3 to a rod-shaped shank 4 with the aid of a collar 40. The head 3 carries a pin 8 as the working element.

Figure 21:
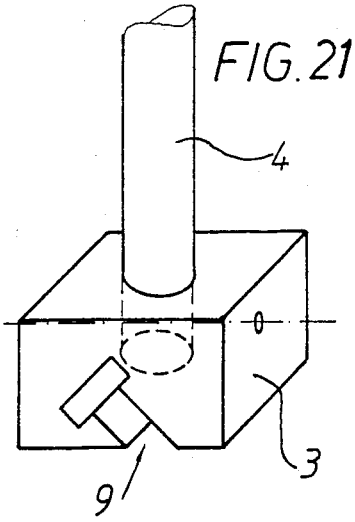

FIG. 21 depicts the possibility of fastening working implemehts to a rod-like shank 4 by means of a head 3 having a parallelepiped shape and by means of a groove 9 having a T-shape in cross section.

Figure 22:
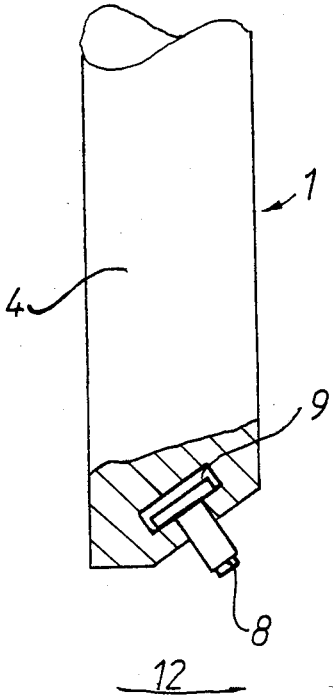

FIG. 22 shows the provision of a groove 9 with a T-shape in cross section for the direct accommodation of working elements, for example a pin 8, at a rod-shaped shank (4) as the holding member (1).

Figure 23:
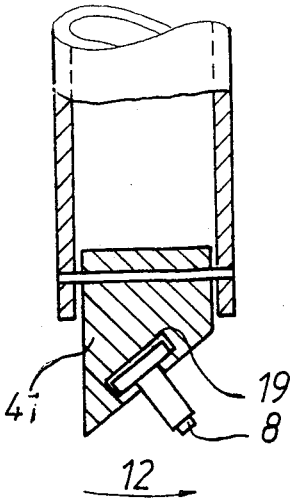

Insofar as the shank 4 is fashioned as a tube, according to FIG. 23, a cylindrical insert member 41, beveled at its free end, can have a groove 9 of a T-shape in cross section as the anchoring means for working elements, for example a pin 8. The insert member 41 is connected in any desired way with the tubular shank 4, for example with the aid of bolts.

I claim:

1. In a holding member for working elements of roller brushes for the treatment of traffic areas in order to remove from the surface thereof coatings such as dirt, snow, ice, paint, abraded rubber, and the like, several said holding members being distributed over the outer surface of a rotatable brush core and being pivotally mounted on the brush core about axes parallel to the axis of rotation of the brush, said holding member comprising a first end adapted to be mounted on the brush core, and second end comprising a radially outwardly located head (3) adapted to receive a said working element, and a shank (4) interconnecting said first and second ends; the improvement in which said first end comprises means for pivotally mounting said holding member on the brush core for pivotal movement about an axis parallel to the axis of rotation of the brush core, and said shank (4) comprises an elastically deformable member.

2. Holding member according to claim 1, wherein said head (3) is thicker than said shank (4).

3. Holding member according to claim 1, and a working element (2) received in said head of said second end.

4. Holding member according to claim 1, wherein said holding member is of one-piece construction, and is formed from an elastic material.

5. Holding member according to claim 1, wherein said shank (4) has a constant cross section over all its length between said first and second ends.

6. Holding member acording to claim 3, wherein said working element (2) is a strip (6) of an elastic material, said strip (6) comprising at least one working edge disposed parallel to said axis of pivotal mounting.

7. Holding member according to claim 6, wherein said strip (6) comprises a plurality of working edges disposed at regular intervals and separated by slits (7) such that said strip (6) has a comb-like configuration.

8. Holding member according to claim 3, wherein said working element (2) is a bristle cluster.

9. Holding member according to claim 3, wherein said working element (2) comprises substantially inflexible pins (8).

10. Holding member according to claim 3, wherein said working element (2) is an exchangeable wearing element.

11. Holding member according to claim 1, wherein said head (3) of said second end comprises grooves (9) extending parallel to said axis of pivotal interconnection, said grooves (9) being adapted to receive a said working element (2).

12. Holding member according to claim 1, wherein said head (3) of said second end comprises mounting rails (10) having radially outwardly extending flanges (11), between which flanges (11) a said working element (2) is adapted to be inserted, said mounting rails (10) being detachably insertable in said head (3) of said second end.

13. Holding member according to claim 1, wherein said head (3) of said second end is adapted to receive a said working element (2) such that said working element (2) forms an acute angle relative to the longitudinal extent of said holding member (1).

14. Holding member according to claim 3, wherein said working element (2) is directed tangentially to said axis of pivotal mounting.

15. Holding member according to claim 3, wherein said working element (2) comprises polygonal platelets (13) having outwardly pointing working portions, said working element (2) being received in slot-like recesses (14) of a mounting strip (15), said mounting strip (15) being removably housed in said head (3) of said second end.

16. Holding member according to claim 15, wherein said mounting strip (15) comprises mutually converging lateral faces (18), said mounting strip (15) being inserted in a correspondingly oppositely shaped, undercut groove of said head (3) of said second end.

17. Holding member according to claim 16, wherein said mounting strip (15) has a trapezoidal cross section.

18. Holding member according to claim 3, wherein said head (3) comprises at least one bore (19) open toward said second end of said holding member, said at least one bore (19) accommodating a said working element (2).

19. Holding member according to claim 18, wherein said working element (2) comprises at least one metallic pin (8) surrounded by a jacket (20) arranged with clearance in said bore (19), said at least one metallic pin (8) having an end flange (21) accommodated in a cavity (22) of said head (3) with axial play.

20. Holding member according to claim 19, wherein each said at least one metallic pin (8) extends at an angle of 0°–45° relative to the longitudinal extent of said holding member.

21. Holding member according to claim 1, wherein said shank (4) contains an elastic strip (24), a majority of said shank lying on a first side of said elastic strip (24), said head (3) being adapted to receive a said working element (2) such that said working element (2) is directed toward a side opposite and first side of said elastic strip (24).

22. Holding member according to claim 3, wherein said working element (2) comprises a plurality of working members each lying in a plane perpendicular to said axis of pivotal mounting and collectively lying in a plane parallel to said axis of pivotal interconnection.

23. Holding member according to claim 7, wherein said strip (6) is angularly offset relative to the longitudinal extent of said shank (4), about an axis parallel to said longitudinal extent of said shank (4).

* * * * *